United States Patent [19]

Kopas

[11] 4,173,371

[45] Nov. 6, 1979

[54] COMBINATION CAB AND CANOPY FOR MINE ROOF BOLTING MACHINE

[75] Inventor: Peter P. Kopas, Nicktown, Pa.

[73] Assignee: Kogen Industries, Inc., Carrolltown, Pa.

[21] Appl. No.: 814,137

[22] Filed: Jul. 8, 1977

[51] Int. Cl.[2] ..... E21C 11/02

[52] U.S. Cl. ..... 296/137 R; 173/23; 180/271; 180/77 MC

[58] Field of Search ..... 296/65 A, 68, 137 C, 296/146; 297/184, 239; 180/82 R, 77; 299/12; 173/23

[56] References Cited

U.S. PATENT DOCUMENTS

| | | | |
|---|---|---|---|
| 2,325,731 | 8/1943 | Arentzen et al. | 180/82 R |
| 2,496,694 | 2/1950 | Brown | 299/12 |
| 3,315,758 | 4/1967 | Allen | 180/77 |
| 3,398,984 | 8/1968 | Ajero | 180/77 |
| 3,768,574 | 10/1973 | Long | 173/23 |
| 3,865,197 | 2/1975 | McCormick | 173/23 |
| 3,937,517 | 2/1976 | Donovan | 296/68 |
| 4,022,026 | 5/1977 | Childress | 173/23 |

*Primary Examiner*—Richard A. Bertsch

*Attorney, Agent, or Firm*—Berman, Aisenberg & Platt

[57] ABSTRACT

A cab which functions as a protective canopy for the operator of a roof bolting machine. The cab/canopy is mounted to the roof bolter in such a fashion so as to permit the operator to both tram and drill roof bolt holes from the same position while being protected from roof falls. Further, the cab/canopy is mounted upon the front of the machine in an articulated manner such that the cab and machine are relatively vertically movable. In this manner, the operator may control the machine with greater surety.

6 Claims, 5 Drawing Figures

COMBINATION CAB AND CANOPY FOR MINE ROOF BOLTING MACHINE

BACKGROUND OF THE INVENTION

1. Field of the Invention

The present invention is related to mine roof bolting machines and, more particularly, is directed towards a combination riding cab and protective canopy for the operator of a mine roof bolting machine.

2. Description of the Prior Art

Mine roof bolting machines are in common use, and generally comprise a wheeled vehicle approximately eight feet wide, twelve to twenty feet long, and approximately thirty inches high, at most. Positioned at the front of the roof bolter is a vertically movable boom which has a drill head mounted thereon. The drill head is adapted to drill a one and one-half inch diameter hole to a depth of four feet, six feet, eight feet, or the like. After the hole is drilled, a roof bolt is inserted and secured by means of an adhesive and hardener, the completed assembly acting to support the lower face of the roof.

Many roof bolting machines are provided with an operator's station which includes hydraulic controls arranged in a valve bank. The controls permit the operator to both drill holes and travel with the machine inside the mine from place to place, i.e., tramming.

It is known to provide a fixed overhead canopy at the rear of a roof bolter to provide the operator with some protection while the machine is trammed. When the desired drilling location is reached, the operator must get out of the rear canopy and move to the front of the machine where the holes are drilled and bolts are installed. This arrangement, in turn, required two canopies: one installed at the rear of the bolter for protecting the operator while tramming, and one installed at the front of the bolter to protect the operator while drilling and installing the bolt. A clear drawback of this arrangement requires the operator to leave the rear cab to reach the front control panel during which time he is exposed and subjected to a possible roof fall and concomitant serious injury.

It would be extremely advantageous if a unitary cab and canopy assembly could be provided which did not dangerously expose the operator during the tramming or drilling operation of a roof bolting machine.

Another disadvantage of prior art roof bolting machines is that the operator's cab from which the controls must be handled is generally rigidly attached to the roof bolter itself. Due to the general unevenness of the floor of the mine, the operator experiences tremendous rocking motions fore and aft during tramming. Since the operator's cab is fixed to the bolter, this motion is transmitted to the operator and encourages abnormal movements of the arms which can lead to erratic operation of the controls. It would be highly advantageous if control of the roof bolter during tramming could be increased.

I am aware of the following United States patents which teach the desirability of utilizing a cab and canopy for mine vehicles: U.S. Pat. Nos. 2,325,731; 2,496,694; 3,315,758; 3,398,984; and 3,937,517.

OBJECTS AND SUMMARY OF THE INVENTION

It is therefore a primary object of the present invention to provide a combination cab and canopy for a roof bolting machine which provides a means whereby the operator of the machine need not be exposed during the normal operation of the roof bolter both during tramming and drilling.

Another object of the present invention is to provide a cab/canopy for a roof bolting machine whose coupling and construction greatly increases the control exercisable by the operator over the hydraulic controls, even when tramming over rough terrain.

Another object of the present invention is to provide a canopied cab for a roof bolting machine which is of simple construction yet is durable, sturdy, and able to provide complete protection for an operator both during tramming and drilling operations.

The foregoing and other objects are attained in accordance with one aspect of the present invention through the provision of an improvement for use with a wheeled roof bolting machine having a vertical movable drill head for drilling holes in the roof of a mine and control means for operating the drill head and for tramming the machine along the floor of the mine. The improvement comprises canopy means located adjacent the drill head and the control means for protecting an operator positioned therein from roof falls and for permitting both tramming and drilling operations to be conducted therefrom without exposure.

In accordance with another aspect of the present invention, means are also provided for coupling the canopy means to the roof bolting machine for permitting independent vertical movement thereof. More particularly, the coupling means comprises at least one vertical support member connected to the roof bolting machine and having an elongated vertical slot formed therein, and a horizontally disposed pin mounted on the canopy means and extending through the slot so as to be freely movable therein. Preferably, the coupling or articulating means includes a second vertical support member which is connected to the roof bolting machine in a position laterally spaced from the first vertical support member and which is substantially identical thereto. A second pin is mounted on the canopy means and cooperates with the second vertical support member to permit relative vertical movement therebetween.

In accordance with yet other aspects of the present invention, the canopy means comprises base means adapted to contact the floor of the mine during tramming and which are also adapted to accommodate an operator of the machine therein, top means vertically spaced over the base means for covering the operator during tramming and drilling, and means for interconnecting the base means and the top means. The base means preferably includes upturned edge means formed about the periphery thereof for facilitating movement of the canopy means over the floor of the mine. In a preferred form, the interconnecting means comprises at least one cylindrical member which is fastened to the base and a piston member connected to the underside of the top and which is adjustably positionable within the cylindrical member. In a preferred form, the cylindrical member and the piston comprise a hydraulic cylinder which is operable to vary the height of the top above the base, the piston member preferably being pivotally mounted to the underside of the top. The base means further comprises means connectable to the vertically movable drill head for permitting the front of the canopy means to be raised during tramming to assist the canopy means in traversing rough terrain.

BRIEF DESCRIPTION OF THE DRAWINGS

Various objects, features and attendant advantages of the present invention will be more fully appreciated as the same become better understood from the following detailed description of the present invention when viewed in conjunction with the accompanying drawings, in which.

DETAILED DESCRIPTION AND THE PREFERRED EMBODIMENT

Figure 1:
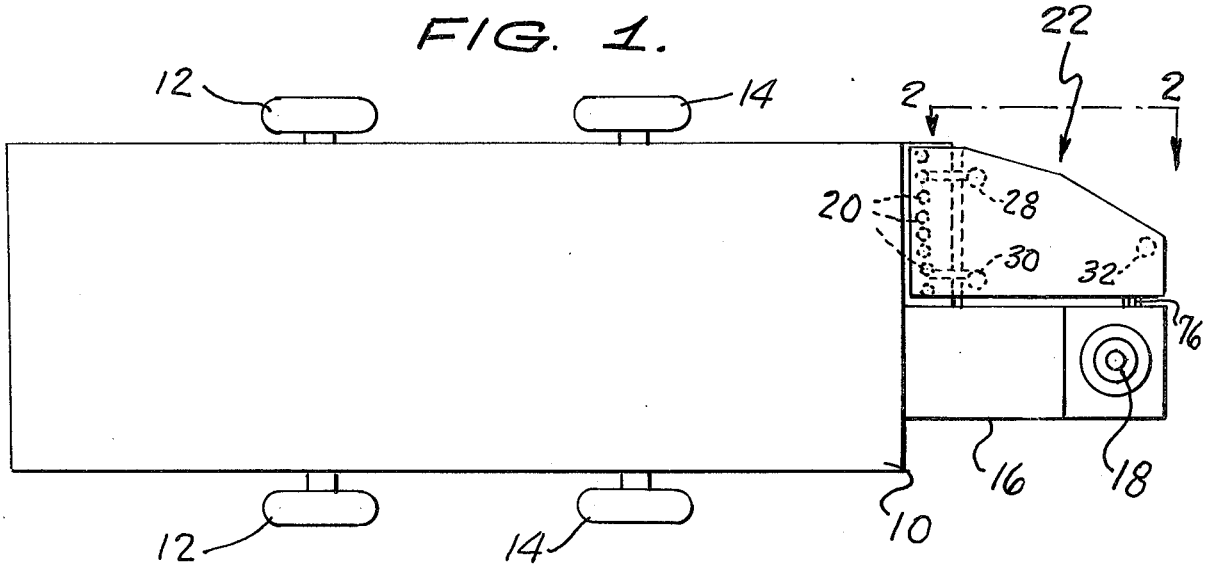
FIG. 1 is a plan view which schematically represents a roof bolting machine having the improved canopy/-cab of the present invention connected thereto.

Referring now to the drawings, wherein like reference numerals represent identical or corresponding parts throughout the several views, and more particularly to FIG. 1 thereof, reference numeral 10 indicates generally the outline of a roof bolter machine such as, for example, may be manufactured by the Fletcher Company. The roof bolter 10 is provided with two rubber rear wheels 12 and a pair of rubber front wheels 14, wheels 12 and 14 permitting the bolter 10 to be trammed from place to place within the mine to those particular locations where roof bolts are desired to be installed.

At the forward end of the roof bolter 10 is positioned a boom 16 which is vertically movable under the control of standard hydraulics (not shown). At the forward end of boom 16 is positioned a drill head 18 which is equipped so as to drill the desired hole in the roof of the mine.

A bank of hydraulic controls is indicated by reference numeral 20 and are seen to be positioned at the forward end of roof bolter 10. Control bank 20 contains valves for controlling both the tramming and drilling operations of the roof bolting machine.

A combination cab and protective canopy is indicated in FIG. 1 by reference numeral 22 and is seen to be positioned adjacent both the drill head 18 as well as the hydraulic control bank 20.

Figure 2:
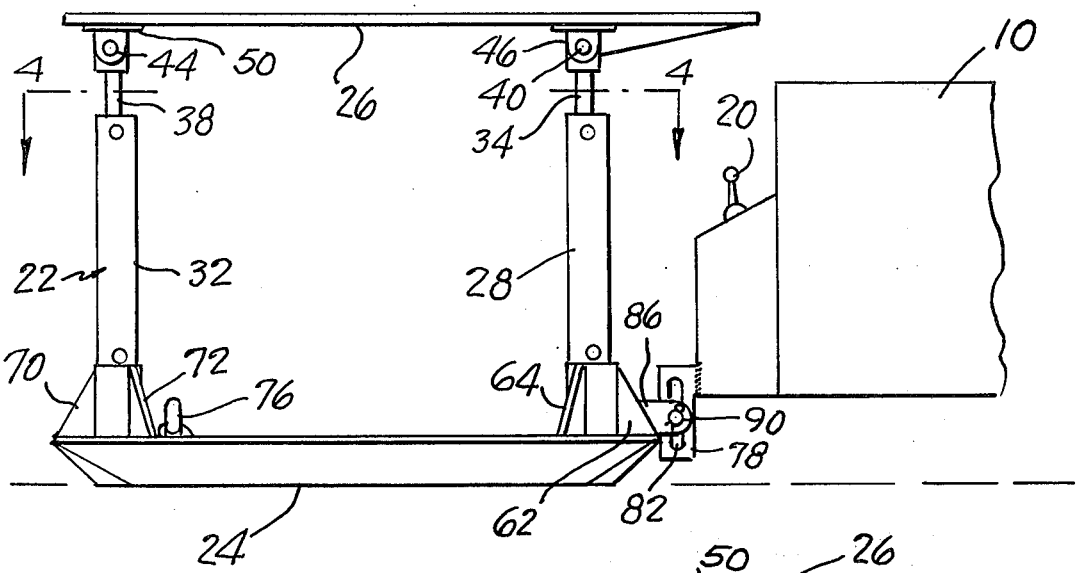
FIG. 2 is an enlarged, side view of the improved cab/canopy of the present invention which is taken along line 2—2 of FIG. 1.
Figure 3:
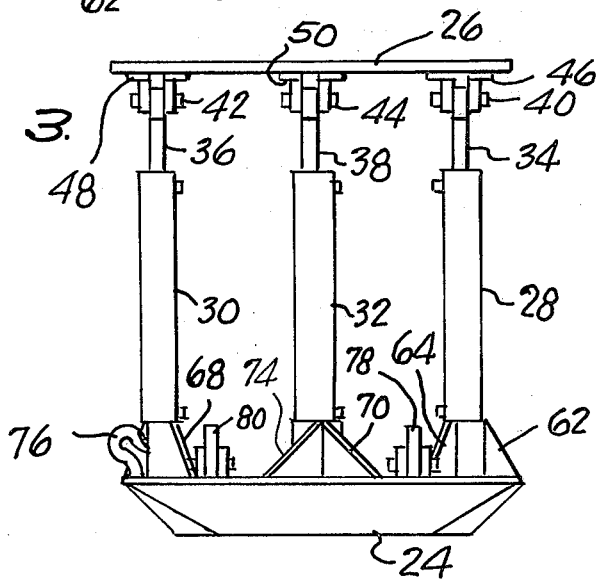
FIG. 3 is an end view of the preferred embodiment of the present invention illustrated in FIG. 2.

The details of construction of the cab and canopy assembly 22 are illustrated more clearly in FIGS. 2 and 3 wherein the assembly is seen to comprise a ground-engaging base member 24, a roof-engaging top member 26, and a plurality of means for interconnecting the base and top members 24 and 26, respectively.

Figure 4:
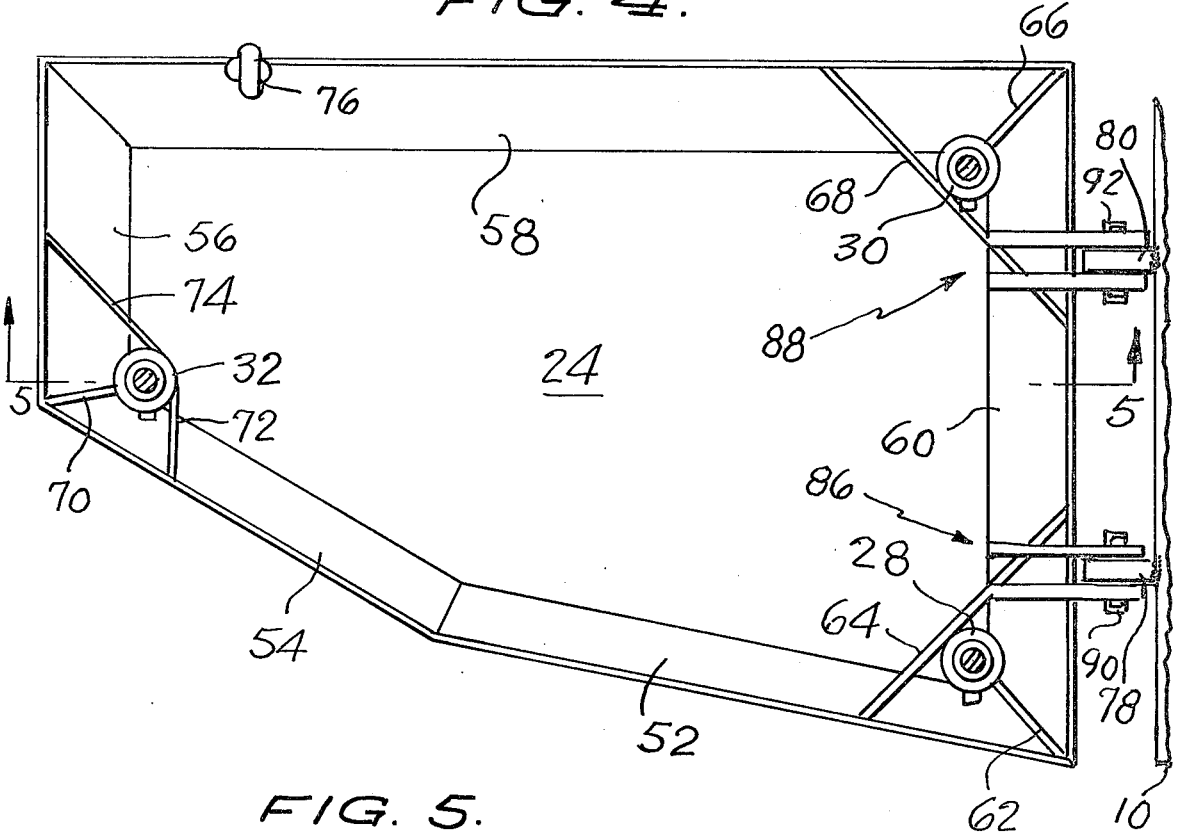
FIG. 4 is an enlarged, sectional view illustrating a portion of the preferred embodiment illustrated in FIG. 2 and taken along line 4–4 thereof.
Figure 5:
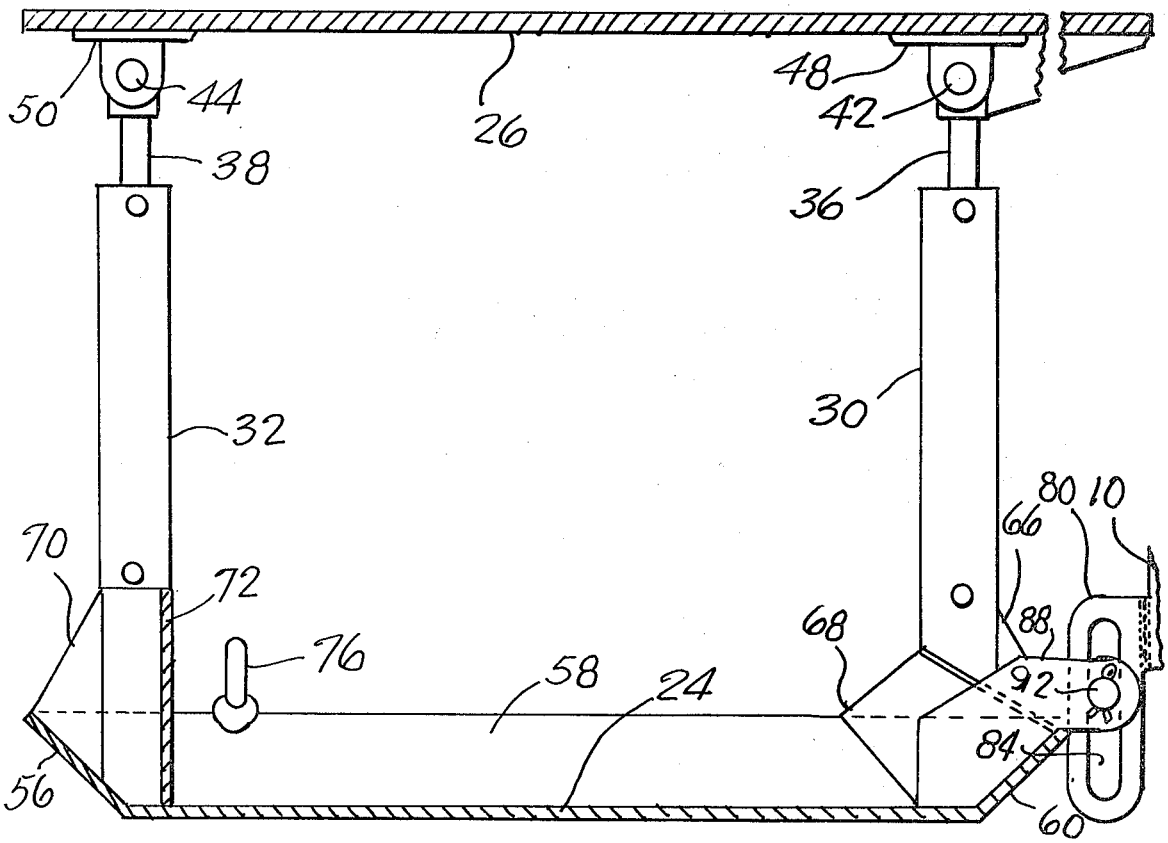
FIG. 5 is a sectional view of the preferred embodiment illustrated in FIG. 4 and taken along line 5—5 thereof.

It may be appreciated from FIGS. 4 and 5 that the base member 24 essentially comprises a substantially planar section of steel plate which may be irregularly shaped as indicated in order to provide greater access in hard to reach mine areas. The peripheral portion of base member 24 preferably includes upturned edges 52, 54, 56, 58 and 60. Since base member 24 rests on the floor of the mine during tramming, the upturned edges 52 through 60 facilitate the movement of the canopy/cab 22 over rough floor terrain. A secondary purpose of the upturned edges 52 through 60 is to help define the outer perimeter of the base member 24 such that the operator positioned thereon will maintain his position in a safe area over which the roof area 26 extends. That is, the peripheral areas 52 through 60 serve as a border defining means to confine the operator within the cab.

In the preferred embodiment, three telescoping cylinder and piston arrangements serve as the support means between the base member 24 and the top member 26. The support means include three cylinders 28, 30 and 32 which are secured in a triangular arrangement to the periphery of the planar portion of the base member 24, as perhaps best seen in FIG. 4. Associated with each of the support cylinders 28, 30 and 32, is a piston 34, 36 and 38, respectively, which are reciprocally positioned therein. The tops of the pistons 34, 36 and 38 are preferably pivotally connected to the underside of top plate 26 via pivot pins 40, 42 and 44 and associated pivot supports 46, 48 and 50, the latter of which are preferably welded to the underside of top plate 26.

The supports may simply comprise telescoping cylindrical tubes and pistons formed of steel, or may alternately be comprised of hydraulic cylinders. The telescoping hydraulic cylinders permit the tops 26 to be adjusted depending on the height of the working area, and further permits the overhead top and protective canopy 26 to act as a roof support during a drilling operation.

Means are also preferably provided for supporting or reinforcing the base of the cylindrical tubes 28, 30 and 32. For example, cylinder 28 may be further supported and reinforced by a pair of brace plates 62 and 64, cylinder 30 is supported by brace plates 66 and 68, while cylinder 32 is supported by brace plates 70, 72 and 74 (see FIG. 4).

As seen perhaps most clearly in FIGS. 2 and 3, an attachment is provided to one side of the forward end of canopy 22 to the base member 24 thereof in the form of a hook 76. The hook 76 permits the forward end of canopy 22 to be raised slightly, by attaching hooks 76 to the vertically moveable boom 16, to ease tramming through very wet or abnormal mine floor conditions.

Attention is now directed to FIGS. 4 and 5 which illustrate most clearly the manner in which the canopy 22 is independently articulated with respect to the roof bolter 10. The coupling between canopy 22 and roof bolter 10 comprises a pair of laterally spaced elongated support bars 78 and 80 which are respectively welded to the lower front end of the roof bolter 10. Each of the elongated support bars 78 and 80 has formed therein a vertically oriented elongated slot 82 and 84, respectively.

Cooperating with the vertically oriented slots 82 and 84 are a pair of pins 90 and 92 which are respectively mounted in two sets of flanges 86 and 88 which are, in turn, welded to the right-most edge 60 (as viewed in FIGS. 4 and 5) of the base member 24. The upper horizontal portion of the flanges 86 and 88 respectively receive the support bars 78 and 80, after which the pins 90 and 92 are placed therethrough, the latter of which may be held in place by conventional cotter pins or the like.

It may be appreciated from the manner of coupling the cab/canopy 22 to the rest of the roof bolter 10 that the two units are individually vertically movable such that any bumps or other disturbances encountered by the machine during tramming will not adversely effect the ride of the cab 24 along the floor. Further, by virtue of the coupling arrangement, the operator is able to exercise greater control over the roof bolter 10 during tramming. This results from the minimization of the transmission of the rocking motions normally imparted by the uneven floor of the mine to the roof bolter and, hence, to the operator in a fixed cab. The abnormal motion is minimized with the present invention by virtue of the independent relative vertical movement capabilities of the cab/canopy 22. Accordingly, the operator is able to exercise a more sure control over the machine.

It may be appreciated that the present invention provides an auxiliary cab and canopy combination which is mounted to the roof bolter in such a manner that the operator can tram and drill roof bolt holes from the same position and be protected from roof falls. In operation, the operator may sit or kneel in a normal roof bolting operating position in the base member 24 of the assembly 22 while tramming the bolter 10 from one point to another, or from one drilling location to the next. After drilling of the hole is completed, the operator stays in the cab 22 and may effectively install the roof bolt without leaving the confines or safety provided by the overhead canopy 26.

Obviously, numerous modifications and variations of the present invention are possible in light of the above teachings. It is therefore to be understood that within the scope of the appended claims, the invention may be practiced otherwise than as specifically described herein.

I claim as my invention.

1. A combination cab and canopy for a mining machine, which comprises:

cab means having a substantially flat bottom plate with an upstanding rim, for accommodating an operator of said mining machine therein, said plate resting and sliding upon the floor of a mine during use with substantially all of its undersurface area in contact with the mine floor;

canopy means positioned over said cab means for covering said operator;

means for vertically elevating and lowering the canopy means and solely connected to said cab means so that the canopy means is completely supported by said cab means and is not directly connected to said mining machine; and means for float coupling said cab means to said mining machine for permitting independent vertical and pivotal movements of said cab and connected canopy means with respect to said mining machine during travel along a mine floor, said coupling means comprising at least one vertical support member having an elongated vertical slot formed therein, and a horizontally disposed pivot pin extending through said slot so as to be freely vertically movable therein, one of said pin and support member being fixed on said cab means and the other being adapted to be fixedly mounted on said mining machine.

2. A combination cab and canopy as set forth in claim 1, wherein said coupling means further comprises a second vertical support member having an elongated vertical slot and disposed at approximately the same horizontal level but laterally spaced from said at least one vertical support member, and a second horizontally disposed pin extending through said slot of said second vertical support member, said second vertical support member and second horizontal pin being adapted to be similarly mounted one on said cab means and the other on said mining machine.

3. A combination cab and canopy as set forth in claim 1, wherein said canopy means includes a substantially flat, horizontal cover plate, and said elevating and lowering means interconnects said cab means and said canopy means in such a manner as to permit said canopy means to be raised or lowered uniformly above said cab means so that it may be positioned in a substantially horizontal plane at any desired height.

4. A combination cab and canopy as set forth in claim 3, wherein said elevating and lowering means comprises a plurality of hydraulic cylinder means vertically disposed at spaced locations between said cab means and said canopy means.

5. A combination cab and canopy as set forth in claim 4, wherein said hydraulic cylinder means comprises three hydraulic cylinders vertically arranged in a triangular configuration between said cab means and said canopy means.

6. A combination cab and canopy as set forth in claim 1, wherein in said coupling means further comprises a hook member disposed on the bottom plate of the cab means at a position displaced from the vertical support member and horizontal pivot pin, said hook member being connectable to operating means on the mining machine for slightly elevating a portion of the cab means during travel along the mine floor.

* * * * *